US011799215B2

(12) United States Patent
Münstermann et al.

(10) Patent No.: US 11,799,215 B2
(45) Date of Patent: Oct. 24, 2023

(54) ELECTRICAL PLUG CONNECTOR

(71) Applicant: WEIDMÜLLER INTERFACE GMBH & CO. KG, Detmold (DE)

(72) Inventors: Jörg Münstermann, Schlangen (DE); Heike Schmidtpott, Bad Salzuflen (DE)

(73) Assignee: Weidmüller Interface GmbH & Co. KG

( * ) Notice: Subject to any disclaimer, the term of this patent is extended or adjusted under 35 U.S.C. 154(b) by 197 days.

(21) Appl. No.: 17/271,371

(22) PCT Filed: Sep. 25, 2019

(86) PCT No.: PCT/EP2019/075813
§ 371 (c)(1),
(2) Date: Jul. 23, 2021

(87) PCT Pub. No.: WO2020/064804
PCT Pub. Date: Apr. 2, 2020

(65) Prior Publication Data

US 2021/0359454 A1 Nov. 18, 2021

(30) Foreign Application Priority Data

Sep. 26, 2018 (DE) ..... 202018105524.0

(51) Int. Cl.
*H01R 4/48* (2006.01)

(52) U.S. Cl.
CPC ..... *H01R 4/4836* (2013.01)

(58) Field of Classification Search
None
See application file for complete search history.

(56) References Cited

U.S. PATENT DOCUMENTS

2011/0207361 A1 8/2011 Heckert et al.
2011/0207372 A1 8/2011 Breen, IV

FOREIGN PATENT DOCUMENTS

DE 202010016710 U1 3/2012
DE 202010016895 U1 3/2012
DE 202009001488 U1 6/2012
DE 202012101449 U1 7/2013
DE 102015101893 A1 8/2016
DE 102018102706 A1 8/2018
(Continued)

*Primary Examiner* — Ross N Gushi
(74) *Attorney, Agent, or Firm* — Laubscher & Laubscher, P.C.

(57) ABSTRACT

An electrical plug connector with a plug end surface which is provided for connecting the electrical plug connector to a mating plug connector includes an electrical contact for connecting an electrical conductor to the electrical plug connector. The plug connector includes a spring cage having a clamping spring acting as a pressure spring and a busbar contact region opposite the clamping spring. The plug connector further includes a single-part or multipart connection housing designed to accommodate the contact and to latch the clamping spring in a latching state in an open position. The latching and open position can be brought out of engagement by inserting the conductor. The plug connector further includes a release element which is provided for releasing the electrical conductor from the contact so that the conductor can be removed from the plug connector. The release element is integrated in the plug connector.

11 Claims, 10 Drawing Sheets

(56) References Cited

FOREIGN PATENT DOCUMENTS

| | | | |
|---|---|---|---|
| EP | 2530784 | A1 | 12/2012 |
| EP | 2917970 | B1 | 12/2016 |
| WO | 2010049197 | A1 | 5/2010 |
| WO | 2012163692 | A1 | 12/2012 |
| WO | 2016083966 | A1 | 6/2016 |
| WO | 2018153862 | A1 | 8/2018 |

10,E

ELECTRICAL PLUG CONNECTOR

This application is a § 371 National Stage Entry of International Patent Application No. PCT/EP2019/075813 filed Sep. 25, 2019. Application No. PCT/EP2019/075813 claims priority of DE 20 2018 105 524.0 filed Sep. 26, 2018. The entire content of these applications is incorporated herein by reference.

BACKGROUND OF THE INVENTION

Published document WO 2012/163692 discloses an electrical plug connector which includes a retaining device for positioning a clamping spring in an open initial state. When the electrical conductor is inserted, the retaining device can be shifted together with the electrical conductor. Here, the conductor cannot be released again from the plug connector.

The object of the present invention therefore is to improve the plug connector so that the conductor, after the insertion and clamping in the plug connector, can be easily and rapidly released again from the plug connector.

SUMMARY OF THE INVENTION

According to a primary object of the invention, an electrical plug connector with a plug surface is provided for connecting the electrical plug connector to a mating plug connector. The plug connector includes an electrical contact and thus acts as a connection device for connecting an electrical conductor to the electrical plug connector. The electrical plug connector includes a spring cage with a clamping spring acting as a pressure spring and a busbar contact region opposite the clamping spring and a connection housing which is configured to accommodate the electrical contact and to latch the clamping spring in a latching state in an open position. The latching and open position of the clamping spring is disengaged by inserting the conductor. The plug connector includes an integral release element for releasing the electrical conductor from the contact either manually or with a tool so that the conductor, after the release element has been actuated, can be removed from the plug connector. The term latching state includes constructions in which the clamping spring is pressed into an open position or held in another manner in such an open position.

The electrical plug connector includes the release element which is provided for releasing the electrical conductor from the contact with or without a tool so that during or after the actuation of the release element, the conductor can be removed from the plug connector. In spite of the very cramped installation space of the plug connector, the integration of the release element in the electrical plug connector can be achieved. This allows the release of the electrical conductor from the contact. Preferably, the clamping spring can be released from the conductor, in particular disengaged from it, by the release element. Thereby, not only can the electrical conductor be removed easily and rapidly from the plug connector, but also the removal of the electrical conductor from the plug connector can be performed by an untrained person with the help of the release element.

According to a preferred embodiment, the electrical conductor can be released from the contact without a tool by the release element. However, other embodiments which provide a tool-actuated release of the electrical conductor from the contact can be provided.

In terms of construction, the release element can be provided in different ways, such as a pressing element or push button or as a pivot element. It is advantageous if the release element protrudes axially from a housing either directly or via an intermediate element such as a slider by which it can be actuated.

According to an alternate embodiment, the release element can be formed or arranged on a slider which can be shifted parallel to a conductor insertion opening and can be moved via the slider or with the slider. With the slider, the clamping spring can be reset into an open state via the release element. However, it is also conceivable to form the release element as a pivot element or on a pivot element.

The release element can also be provided in an assembly to latch the clamping spring in a latching state in the open position, wherein this latching and open position can be released by inserting the conductor—but also preferably by actuation of the release element.

The release element can be formed or arranged on a shiftable sleeve which forms the slider. The sleeve protrudes axially from the plug conductor so that it can be easily actuated or moved. In this way, the release element is integrated in a space-saving manner in the plug connector or its housing, in particular if the sleeve is also used for passing the conductor into the contact site or clamping site of the clamping cage.

The slider can be formed as a sleeve or in a fundamentally different manner so that the electrical conductor can be inserted into the slider, and the slider can include a conductor chamber for accommodating the conductor. The chamber can be arranged between the busbar contact region and the clamping spring of the contact. It is precisely in the case of a design of the plug connector for connecting only a single conductor that the design of the slider as a sleeve, in particular as a sleeve which is circumferentially closed at least in sections, is advantageous, especially since the sleeve can be accommodated very satisfactorily in a compact manner on such a plug connector. In fact, a sleeve on such a plug connector as a device for assisting the wiring and insertion is already known per se. However, it was not recognized that, in combination with the release element, this sleeve is also suitable as an actuation element for releasing the conductor, so that the plug connector can be reused.

Preferably, the slider can be shifted from a delivery state, in which the electrical conductor can be inserted into the spring cage, into a connection state, in which the clamping spring is in contact with the electrical conductor and clamps the electrical conductor in the spring cage. The plug connector can be transferred back into the delivery state by the release element. As a result, the plug connector can be reused. Consequently, the costs of a new electrical plug connector can be saved.

In terms of construction and for easy handling in the sense of a quick conductor connection and/or conductor exchange, the slider-like release element is mounted in a shiftable manner in the contact on the conductor insertion side of the spring cage. The conductor can simply be released again from the plug connector by an additional shifting of the slider by the release element in the conductor insertion direction. The release element of this embodiment can be formed as a plate which extends at least partially in the conductor insertion direction.

However, in the case of a release element formed as a plate, the release element can also be formed or provided so that it can be moved, in particular shifted, in the plug connector by a tool. The conductor can then be released from the plug connector by actuating the plate in the conductor insertion direction by the tool such as a screwdriver.

In addition, the release element configured as a plate can also extend at least partially in a release direction transverse to the conductor insertion direction. In this embodiment, the conductor can be released from the plug connector by shifting the plate in the release direction.

All of the embodiments with a release element formed as a plate have in common the fact that at least the clamping arm of the clamping spring is removed from contact with the conductor when the plate is shifted and that the conductor can then be removed from the plug connector by pulling out against the conductor insertion direction.

In another embodiment, a portion of the clamping spring forms the release element. Preferably, the clamping spring includes two spring arms, wherein the first of the two spring arms includes a free arm end which is used for clamping the electrical conductor in the clamping cage. In this embodiment, the second of the two spring arms is preferably formed as a release device. The clamping spring of this embodiment can preferably be rotated about a rotation axis. When the second spring arm forming the release element is actuated in a rotation direction, the clamping spring rotates so that a conductor inserted into the plug connector is clamped. On the other hand, when the second spring arm is actuated against the rotation direction, the conductor which is inserted into the plug connector is released. This embodiment also allows a very rapid and easy connection or exchange of the electrical conductor.

In a preferred embodiment, the plug connector can be provided for connecting only a single conductor. In another preferred embodiment, the plug connector can be designed as a circular plug connector.

BRIEF DESCRIPTION OF THE FIGURES

The invention is described in further detail in reference to the accompanying drawings in which.

DETAILED DESCRIPTION

Figure 1A:
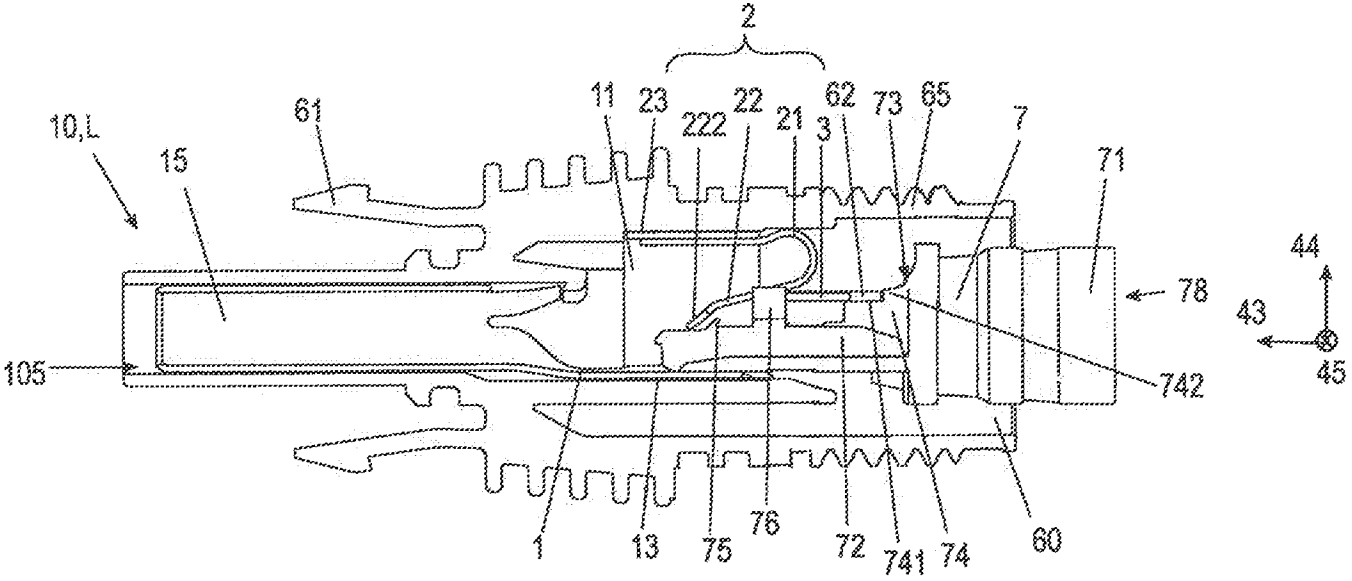
FIGS. 1*a*-1*e* are side sectional views, respectively, showing various stages of clamping an electrical conductor in a first embodiment of an electrical plug connector according to the invention.

FIGS. 1*a*-1*e* show the clamping and contacting of an electrical conductor 4 FIGS. 1*f*-1*i* show the release of the electrical conductor 4 from a first embodiment of an electrical plug connector 10 according to the invention. FIG. 1*j* is a view of the plug connector 10 rotated by 90°.

The plug connector 10 includes an electrical contact 1 in the form of a conductor connection device which is provided and formed for connecting the electrical conductor 4 to the plug connector 10. The contact 1 can include a spring cage 11, in which a clamping spring 2 is secured and which acts as a pressure spring during the contacting. The spring cage 11 can be formed in its entirety or in sections from a satisfactorily conductive busbar material. The clamping spring 2 can be designed as V-shaped. It includes a first spring arm 22 which includes a free arm end 222 for clamping the electrical conductor 4 in the spring cage 11. The clamping spring also includes a second spring arm 23 which is arranged opposite the first spring arm 22. For this purpose, the clamp spring 2 has a bend 21. As a result, the first and the second spring arms 22, 23 extend in the shape of a V in a release state or almost parallel to one another in a contact state. The second spring arm 23 can be secured on the spring cage 11. Such contacts are also referred to as direct plug connections or push-in connections.

Moreover, the plug connector 10 includes a plug end portion 105 which is provided for connecting the plug connector 10 to a mating plug connector, not shown. For this purpose, the contact 1 can be conductively connected to a contact sleeve 15 which forms a socket and which is provided for accommodating a contact plug (not shown) of the mating plug connector. In an alternative embodiment, the contact 1 can also be connected with a contact plug (not shown) which is provided for insertion into a contact sleeve (not shown) of the mating plug connector.

The contact 1 is arranged in an inner chamber 60 of a plug connector housing or connection housing 6. The connection housing 6 can include latching hooks 61 by which the plug connector 10 can be fastened to a mating plug connector. In addition, the connection housing 6 here surrounds the contact sleeve 15 of the contact 1. The contact sleeve 15 or the contact plug or pin, together with the connection housing 6, forms the plug end portion 105 of the plug connector 10.

In addition, the plug connector 10 can include a slider 7. The slider 7 can be arranged on the side of the contact 1 opposite the contact sleeve 15 and can be inserted into the contact. The slider can also be arranged in sections in the inner chamber 60 of the connection housing 6 and protrude axially from its end.

The electrical conductor 4 can be inserted into the slider 7. For this purpose, the slider 7 can include a conductor receptacle 72, in particular a groove-like conductor receptacle, which is provided for accommodating the conductor 4.

The slider 7 includes a sleeve 71 which has a conductor insertion opening 78 through which the conductor 4 can be inserted into the conductor receptacle 72 from the open end of the connection housing 6 in the conductor insertion direction 43.

The electrical conductor 4 includes an electrically conductive core 41 which can be designed as a solid conductor or as a stranded conductor. The core 41 is surrounded with an electrically insulating layer or cover 42. For the connection of the electrical conductor 4 to the plug connector 10, the conductor is stripped of insulation on a free end, and the stripped end is inserted through the sleeve 71 into the conductor receptacle 72 so that at least a short portion of the insulation layer 42 is surrounded by the sleeve 71. Thereby, the sleeve 71 and the layer 42 provide contact protection for an operator. The sleeve 71 is designed in sections like an insertion funnel against which the conductor insulation layer 42 abuts when the conductor is inserted, while the stripped end is inserted into the spring cage as also shown in FIG. 1*k*.

The spring cage 11 in addition includes a busbar contact region 13—designed, for example, as a conductive busbar or directly as part of the spring cage—which is arranged opposite the clamping spring 2. The conductor receptacle 72 is arranged and can be shifted between the busbar contact region 13 and the clamping spring 2 of the contact 1. From a delivery state L of the plug connector 10 shown in FIG. 1*a* in which the electrical conductor 4 can be inserted into the spring cage 11, the slider 7 can be shifted in the conductor insertion direction 43 until, in a connection state A of the plug connector, the clamping spring 2 is in contact with the electrical conductor 4 and clamps the electrical conductor in the spring cage 11.

In addition, the plug connector 10 includes a release element 3. The release element 3 is provided for releasing the electrical conductor 4 from the contact 1 either without a tool and/or actuated with a tool. By actuating the release element 3, the free arm end 222 of the first spring arm 22 of the clamping spring 2 can be taken off or disengaged from the conductor, so that the conductor 4 can be removed from the plug connector 10.

The release element 3 in the embodiment of FIGS. 1*a-k* is designed as a plate. It can be made of metal or of another material. It extends in a plane which is defined by the conductor insertion direction 43 and an extension direction 45 transverse to the conductor insertion direction. The release element is mounted in the connection housing 6 and arranged approximately parallel to a contact surface 742 provided on the slider. For this purpose, on opposite sides of the connection housing 6, a link 62 is provided in each case. The release element 3 extends from one of the links 62 to the opposite link 62 and in each case rests thereon.

The connection housing 6 can be formed as a single part or in multiple parts, in particular in two parts. For this purpose, a sleeve-like housing end portion 5 can be fastened on the sleeve-like connection housing 6. The sleeve-like housing end portion 5 can be screwed or slidingly latched onto the connection housing 6. For this purpose, the connection housing 6 includes a thread 65, in particular an outer thread, and the sleeve-like housing end portion 5 includes a mating thread 55, in particular an inner thread.

Figure 2A:
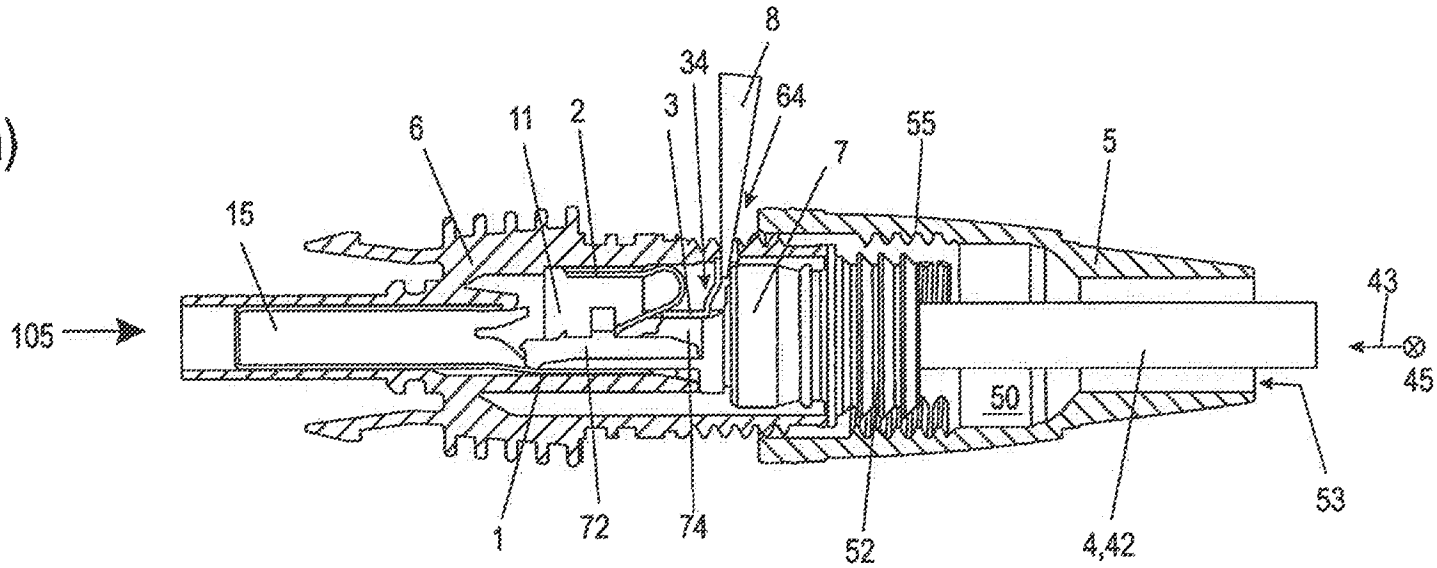
FIGS. 2*a* and 2*b* are sectional views of a second embodiment of an electrical plug connector with a release element in the engaged and released positions, respectively.

For accommodating the conductor 4 as well as a portion of the slider 7, the sleeve-like housing end portion 5 includes an inner chamber 50 (see FIG. 2*a*). A conductor 4 fastened in the plug connector 10 extends through a conductor insertion opening 53 of the sleeve-like housing end portion 5, and the conductor insertion opening 78 of the sleeve 71 extends into the conductor receptacle 72.

FIG. 1*a* shows the plug connector 10 in which the slider 7 is arranged in the delivery state L. In the delivery state, the clamping spring 2 is held in an open state. This can be implemented in a different manner. In the delivery state, preferably one or more of the sleeve or the slider 7 (thus, for example, according to a preferred embodiment, an end of the slider, which lies behind the contact web 75 in the conductor insertion direction) holds the first spring arm 22 in an open position arranged or preloaded outside the conductor receptacle 72. As a result, the conductor 4 can be inserted into the conductor receptacle 72.

Figure 1B:
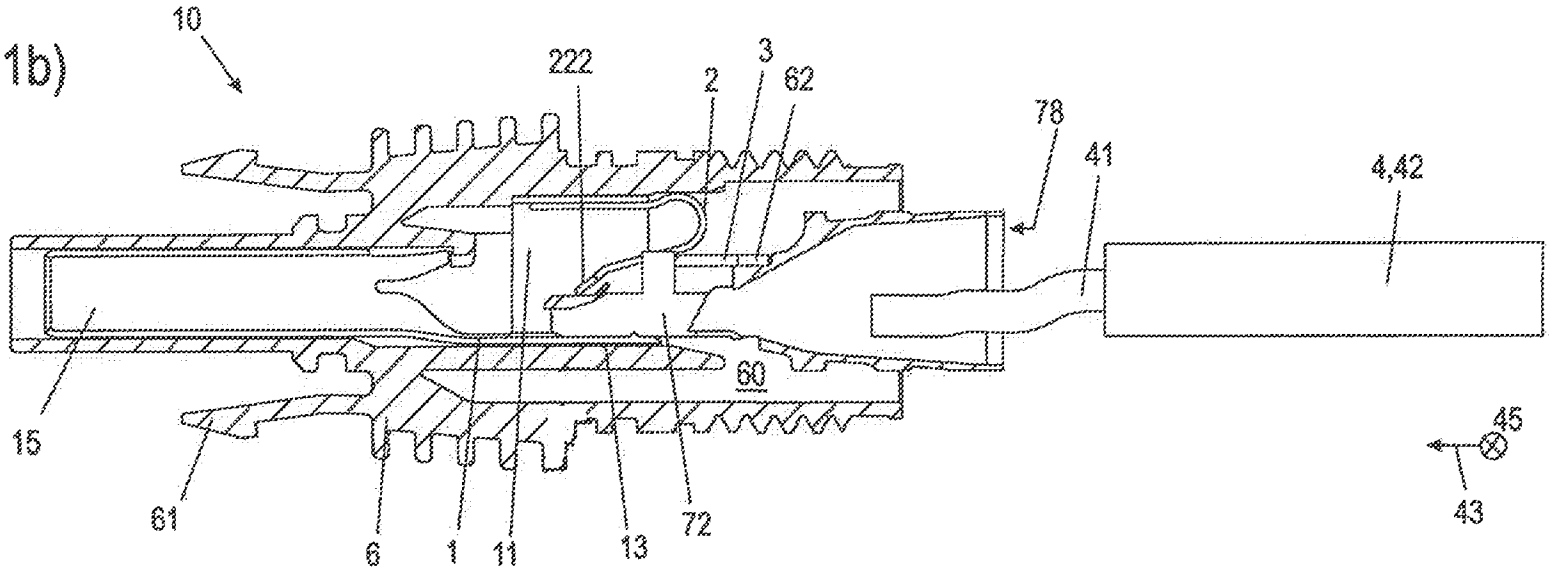
Figure 1C:
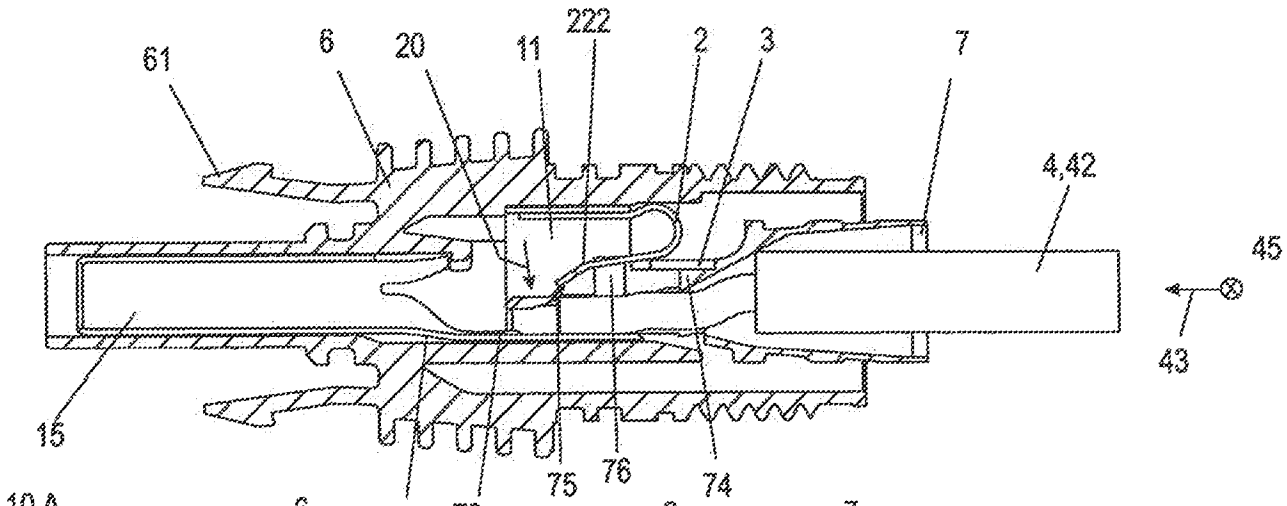
Figure 1D:
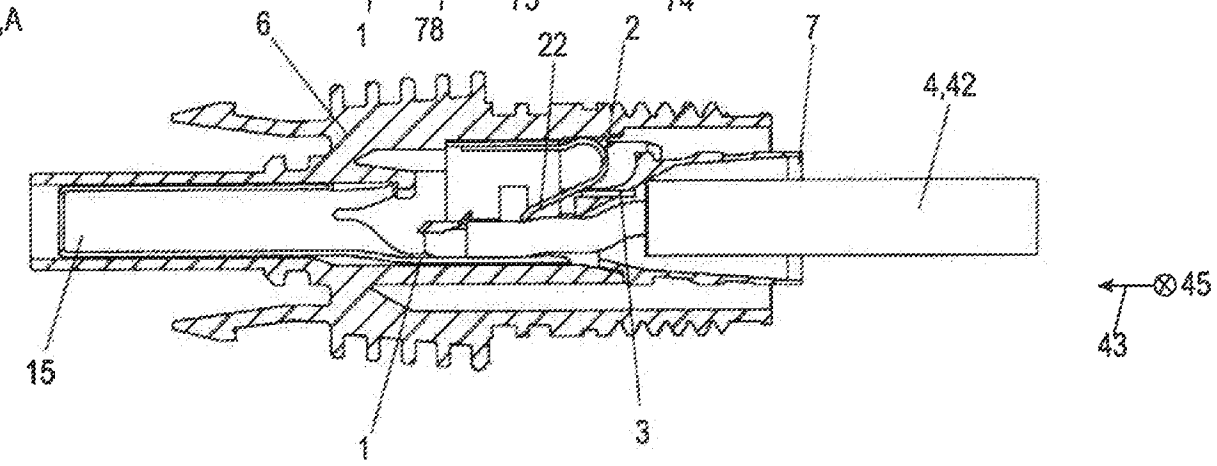

FIG. 1*b* shows the plug connector 10 during the insertion of the electrical conductor 4 in the conductor insertion direction 43 through the conductor insertion opening 78 of the sleeve 71 into the conductor receptacle 72 of the slider 7. During the insertion into an end 78 of the sleeve, the conductor 4 abuts on the inside against the sleeve 71 (for example, in an abutment region 743 or against the contact web 75), then takes the slider 7 along with it and, together with the latter, is moved or inserted further linearly and axially as shown in FIG. 1*c* and FIG. 1*k*. Here, a support surface 741 of a supporting part 74 of the slider 7 lies under the release element 3.

The release element 3, represented in a top view in FIG. 1*j*, can be formed as approximately U-shaped including a cross web 32 and a holding arm 31 on each end. In the installed state, the holding arms 31 extend from the cross web 32 against the conductor insertion direction. Between the holding arms 31, an inner edge 321 of the cross web 32 extends.

When the slider 7 is shifted in the conductor insertion direction 43, the inner edge 321 is in contact with the contact surface 742 of the supporting part 74 which extends transversely to the support surface 741 of the supporting part 74. In addition, the tongues 76 of the supporting part are shifted along with it in the conductor insertion direction 43. The spring arm 22 is thus first in contact with the contact web 75 which extends in the extension direction 45 and is arranged on the conductor receptacle 72 of the slider. Upon further insertion, the free end of the clamping spring 2 slips beyond the contact web 75, until the first spring arm 22 of the clamping spring 2 is released. As a result, the first spring arm 22 can be turned by a resetting force of the clamping spring 2 in a clamping direction 20 toward the conductor receptacle 72. As a result, the clamping spring 2 is in contact with the electrical conductor 4, so that the conductor 4 is clamped in the plug connector 10. The slider 7 is then in the connection state shown in FIG. 1*d*.

Figure 1E:
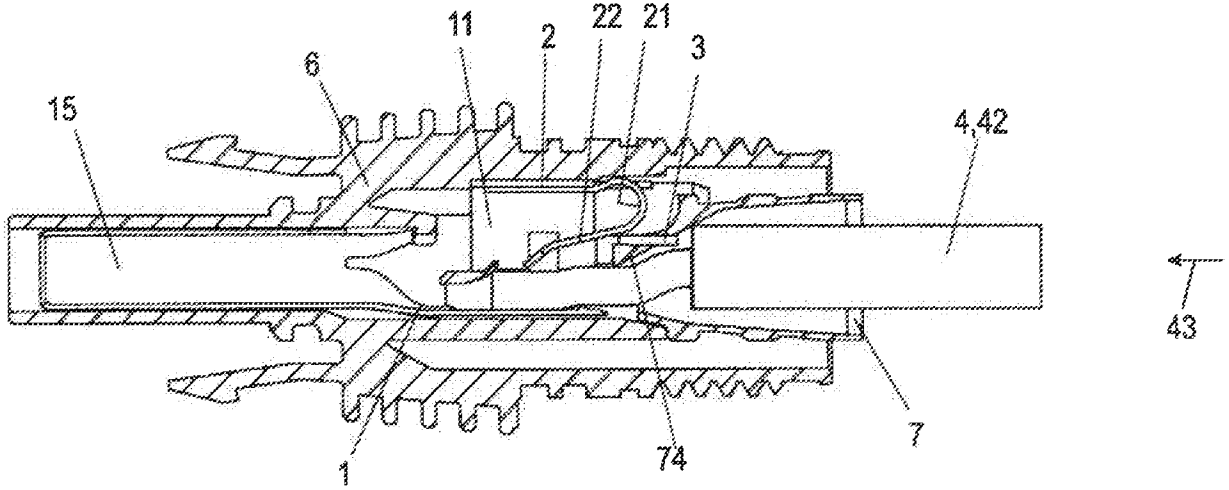
Figure 1F:
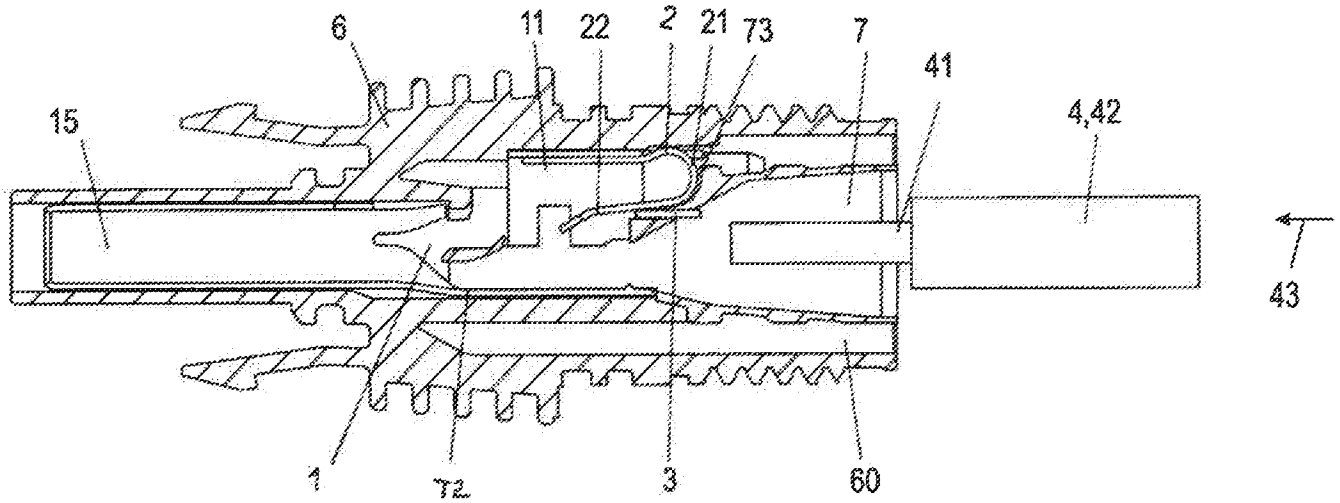
FIGS. 1*f*-1*i* are side sectional views, respectively, showing various stages of release of an electrical conductor from the electrical plug connector of FIGS. 1*a*-1*e;*
Figure 1G:
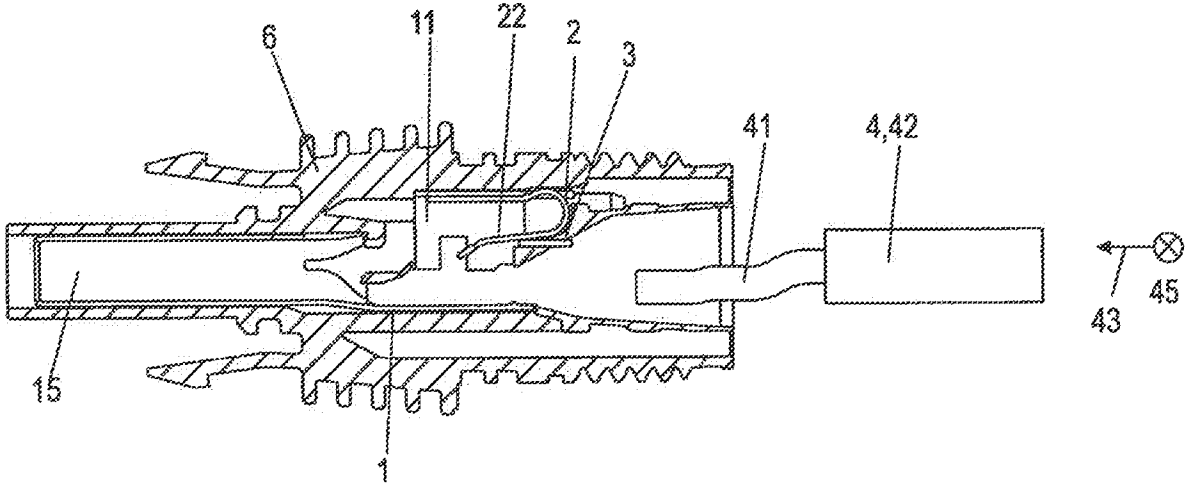

In order to be able to release the electrical conductor 4 again and remove it from the plug connector 10, first the slider 7 is shifted further in the conductor insertion direction 43 as shown in FIG. 1*e*. Since the inner edge 321 is in contact with a contact surface 742 of the supporting part 74, the release element is moved along with it by the slider 7. The release element is then shifted under the first spring arm 22 of the clamping spring 2 and presses the arm against the clamping direction 20 and against the resetting force of the clamping spring 2 away from the conductor 4, until the bend 21 of the clamping spring 2 abuts against an abutment surface 73 of the slider 7. The plug connector 10 is now in the removal state E shown in FIG. 1*f*. In this state, the electrical conductor 4 can again be removed from the plug connector 10. The removal of the electrical conductor 4 is shown in FIG. 1*g*.

Figure 1H:
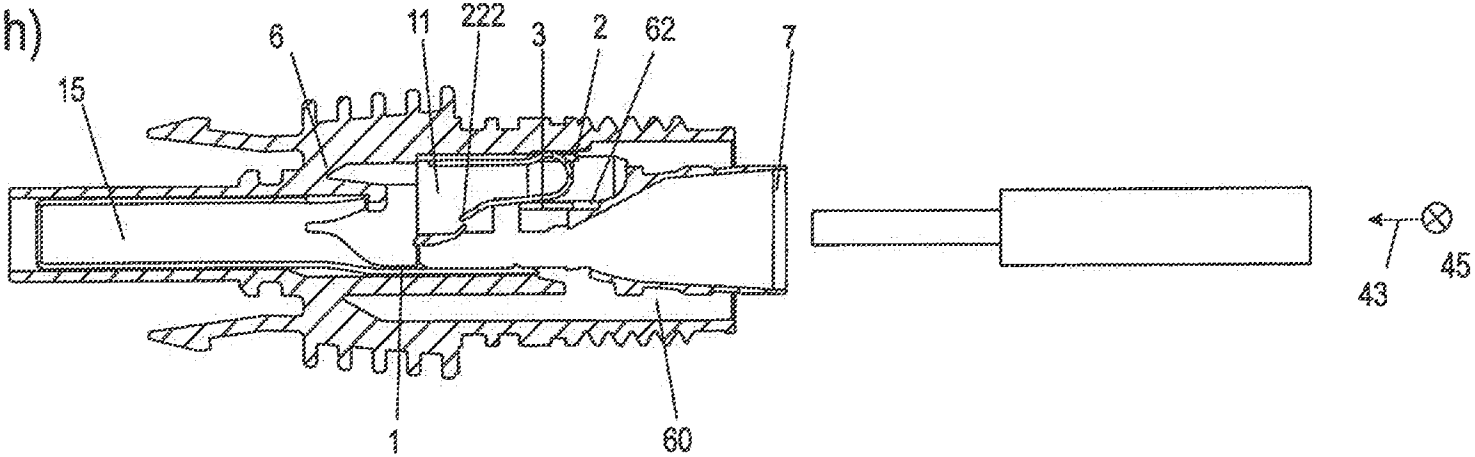
Figure 1I:
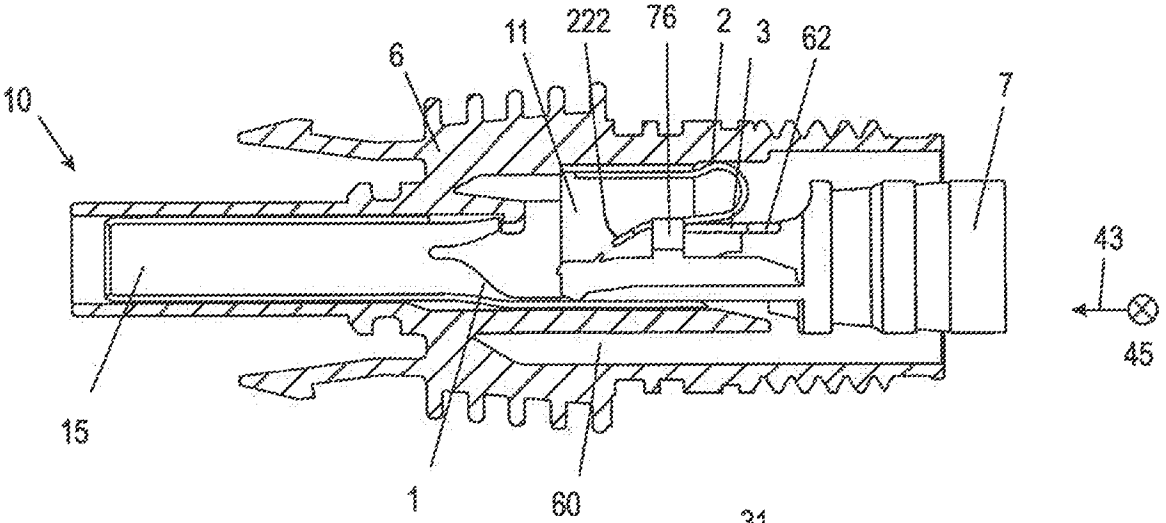
Figure 1J:
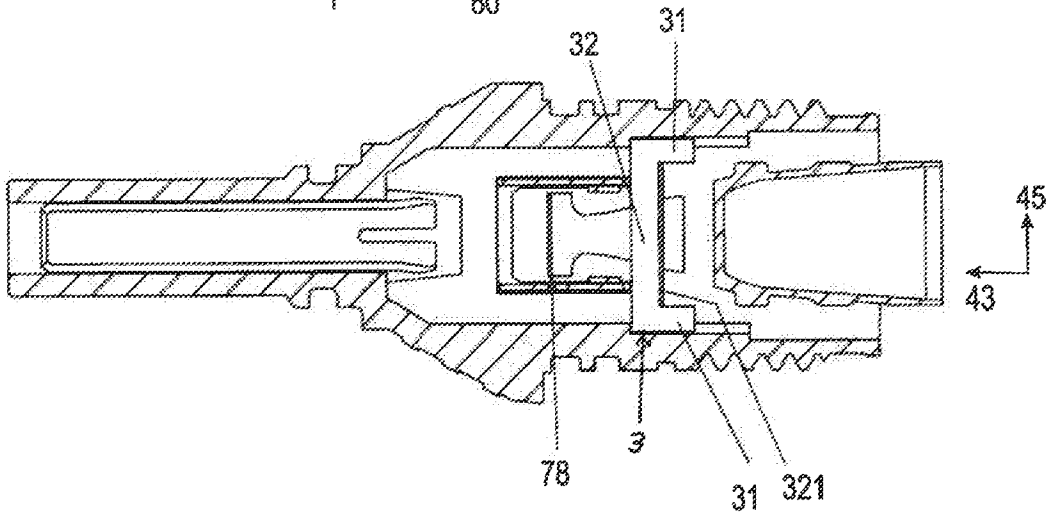
FIG. 1*j* is a top sectional view of the plug connector of FIGS. 1*a*-1*i;*
Figure 1K:
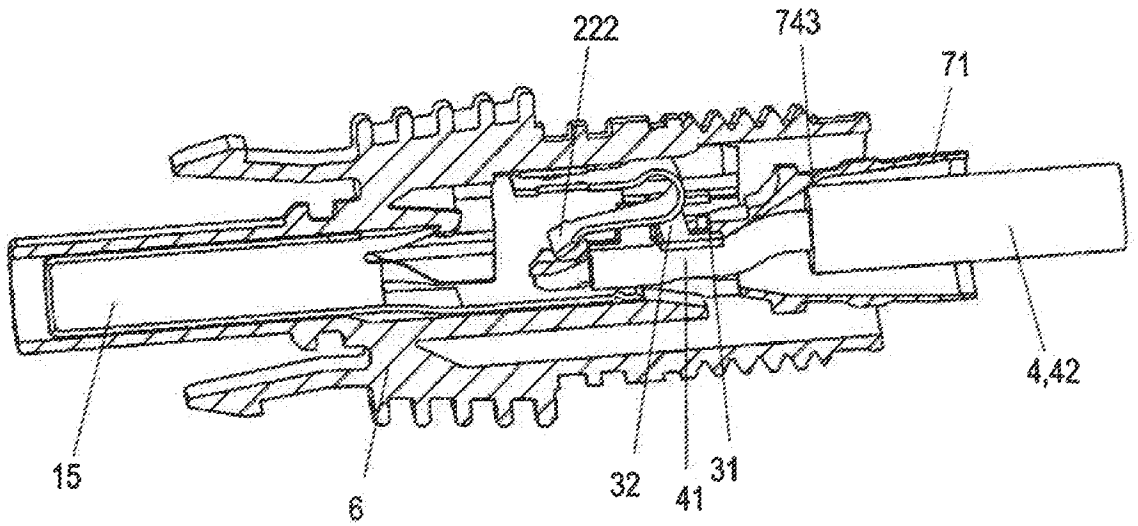
FIG. 1*k* is a perspective view of a conductor being inserted into the plug connector of FIGS. 1*a*-1*j;*

In order to transfer the electrical conductor 4 back into the delivery state L, the slider 7 is then pulled against the conductor insertion direction 43. Here, the first spring arm 22 firmly holds the release element 3 by the resetting force of the clamping spring 2, so that the release element is not pulled back with the slider 7 against the conductor insertion direction 43 as shown in FIGS. 1*h*-1*j*.

Here, the tongues 76 are pulled back with the slider 7 against the conductor insertion direction 43, wherein the webs are shifted under the first spring arm 22. Moreover, the free arm end 222 of the first spring arm is wider than the first spring arm 22. As a result, the free arm end 222 can lie again on the end of the slider 7 behind the contact web 75.

The plug connector 10 is now again in the delivery state L shown in FIG. 1*a*.

FIGS. 2-5 show respective additional embodiments of electrical plug connectors 10 according to the invention, wherein in FIGS. 2*a*, 3*a*, 4*a*, and 5*a* a connection state is shown, and in the other figures a release state is shown.

The embodiments differ above all by the design of the release element 3. The release elements 3 of the plug connector 10 of FIGS. 2-5 are in each case implemented as a plate and produced as stamped bent parts.

Figure 2B:
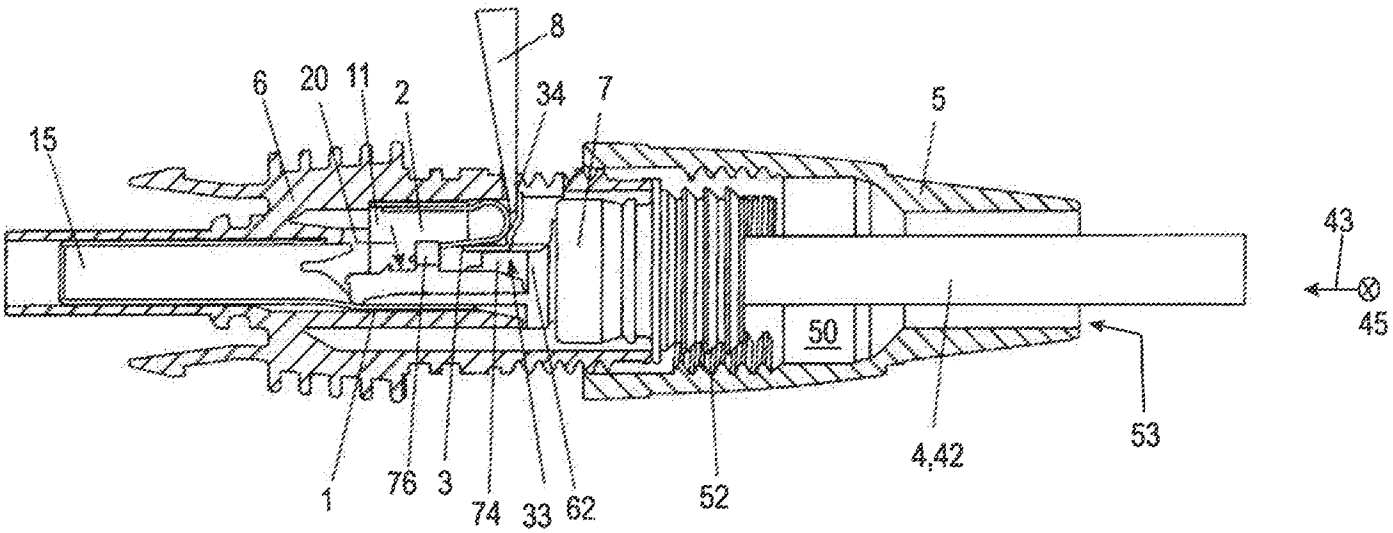

The plate used as release element 3 of the embodiment of FIGS. 2*a* and 2*b* has a pressing section 34 extending transversely to the plane in which the cross web 32 is arranged. Between the pressing section 34 and the cross web 32, a step 33 is provided. The pressing section 34 can be actuated with a tool such as, for example, a screwdriver 8.

FIG. 2*a* shows the plug connector 10 with the connection housing 6 and its sleeve-like housing end part 5. In order to be able to actuate the release element 3, a tool insertion opening 64, arranged in the region of the thread 65 of the connection housing 6, must be accessible. In FIG. 2*a*, the connection housing 6 is therefore slid only partially onto the sleeve-like housing end portion 5. Thereby, the tool insertion opening 64 is accessible from outside.

In FIG. 2*a*, the electrical conductor 4 is clamped in the plug connector 10. The plug connector 10 is in a connection state. By actuating the pressing section 34 of the release element 3 with the screwdriver 8, the release element can be shifted along the links 62 of the connection housing 6 under the first spring arm 22 so that the first spring arm is taken off of the conductor 4. The release element 3 then presses the first spring arm 22 against the clamping direction 20 and against the resetting force of the clamping spring 2.

In FIG. 2*b*, on the other hand, the screwdriver 8 is inserted through the tool insertion opening 64 between the bend 21 of the clamping spring 2 and the pressing section 34 of the release element 3. In order to clamp the conductor 4, after the conductor 4 has been inserted into the plug connector 10 in the conductor insertion direction 43, the screwdriver 8 is turned. Since the screwdriver 8 is braced on the bend 21 of the clamping spring 2, the pressing section 34 is as a result shifted against the conductor insertion direction 43 and releases the first spring arm 22.

Protection against dust and moisture can be ensured in the plug connector 10 by an insulation insert 52 which is arranged in the sleeve-like housing end part 5. The insulation body 52 surrounds the sleeve 71 of the slider 7 as well as a portion of the electrical conductor 4 at least in sections to its full extent.

Figure 3A:
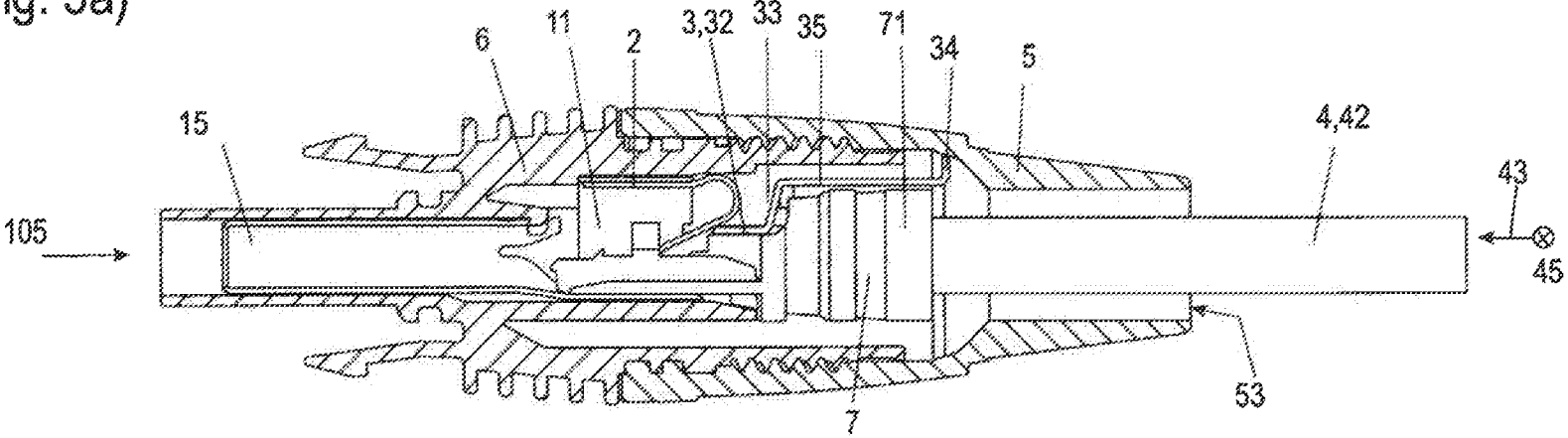
FIGS. 3*a* and 3*b* are sectional views of a third embodiment of an electrical plug connector with a release element in the engaged and released positions, respectively.
Figure 3B:
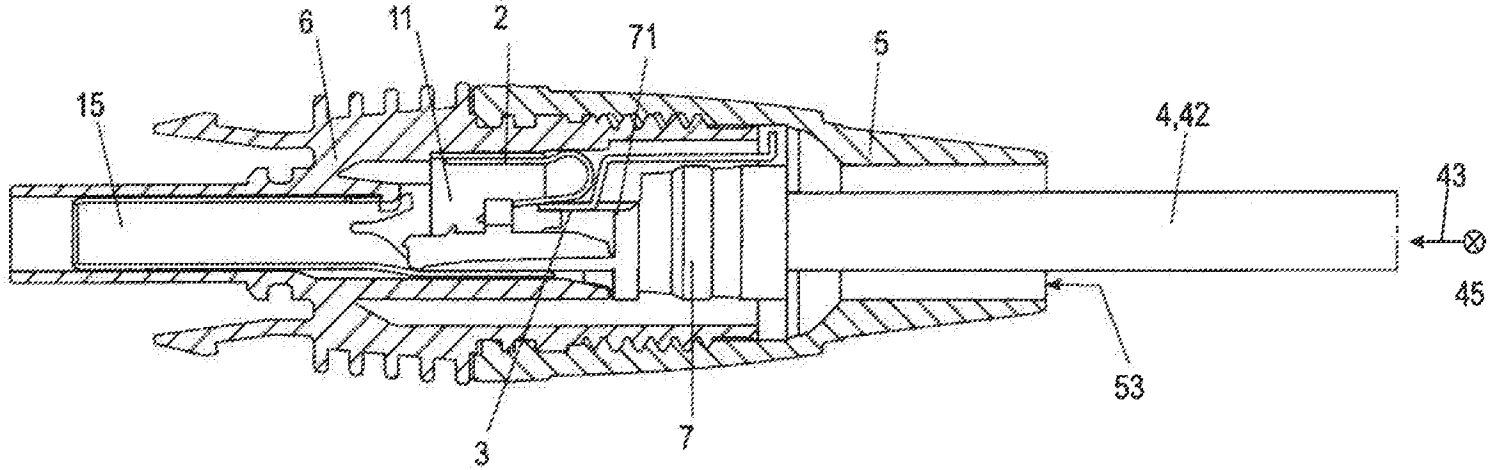

The release element 3 of the plug connector 10 of FIGS. 3*a* and 3*b* includes an extension arm 35 which is connected analogously to the embodiment of FIGS. 2*a* and 2*b* via a step 33 to the cross web 32. The step 33 is selected to be sufficiently large so that the extension arm 35 extends beyond the sleeve 71 and against the conductor insertion direction 43. The pressing section 34 is arranged on an end of the release element 3 opposite the cross web 32. It extends transversely to the plane in which the cross web 32 is arranged.

This plug connector 10 can be actuated similar to the plug connector 10 of FIG. 1 by shifting the slider 7 in and against the conductor insertion direction 43.

Figure 4A:
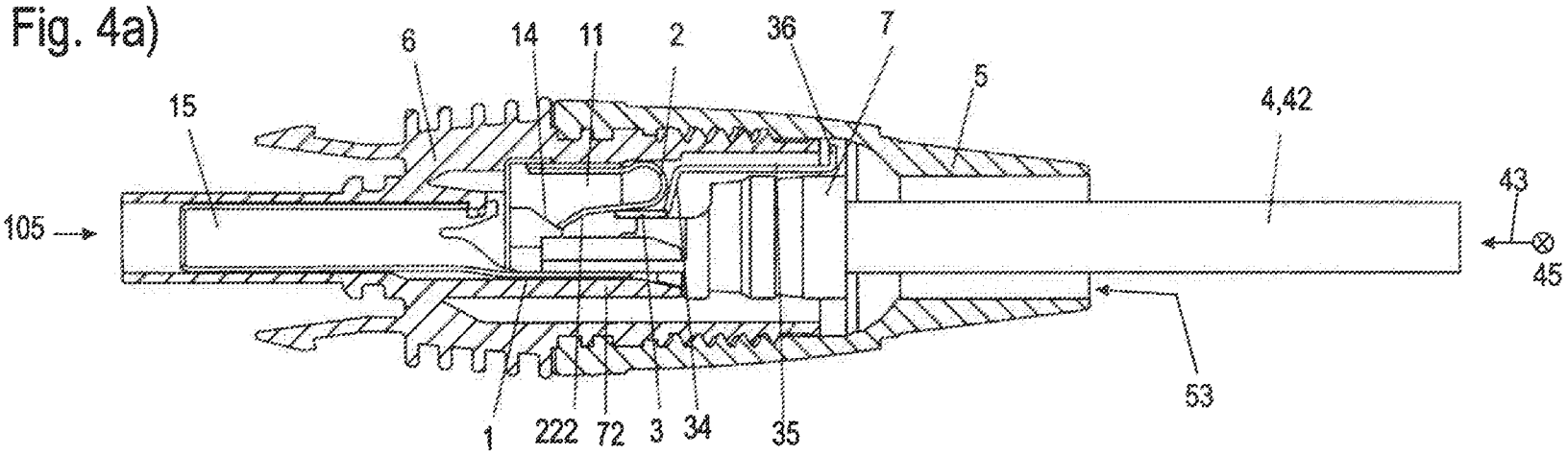
FIGS. 4*a* and 4*b* are sectional views of a fourth embodiment of an electrical plug connector with a release element in the engaged and released positions, respectively.
Figure 4B:
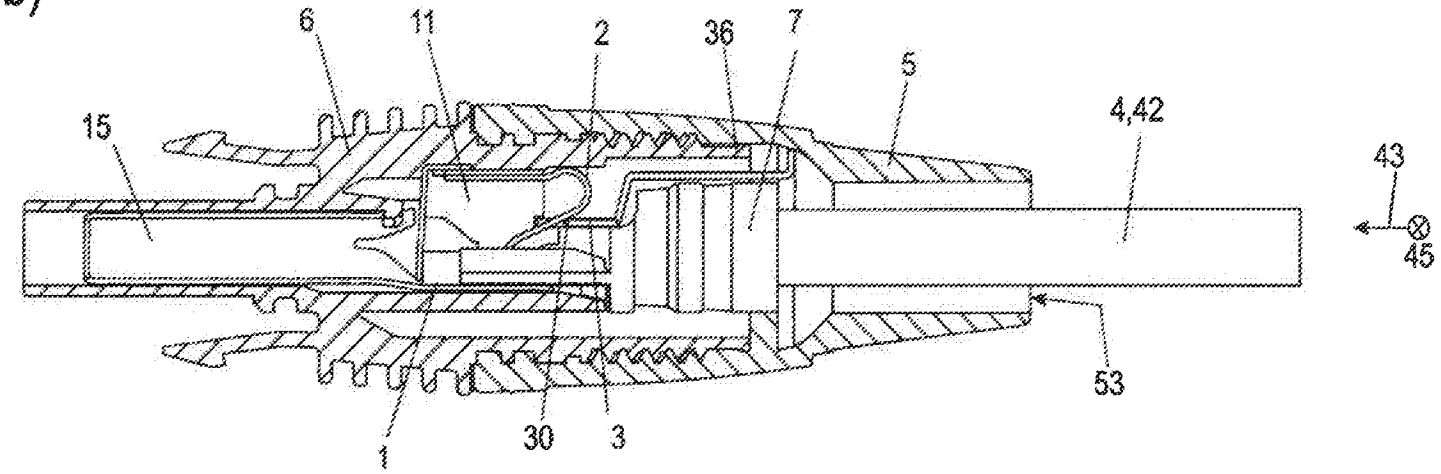

In the plug connector 10 of FIGS. 4*a* and *b*, the first spring arm 22, in the delivery state L of the plug connector, is laid down on a latching ramp 14. The clamping of the electrical conductor 4 until it is in connection state A of FIG. 4*b* and the renewed release of the electrical conductor 4 from the plug connector 10 otherwise also occur similar to the embodiments of FIGS. 1 and 3.

Figure 5A:
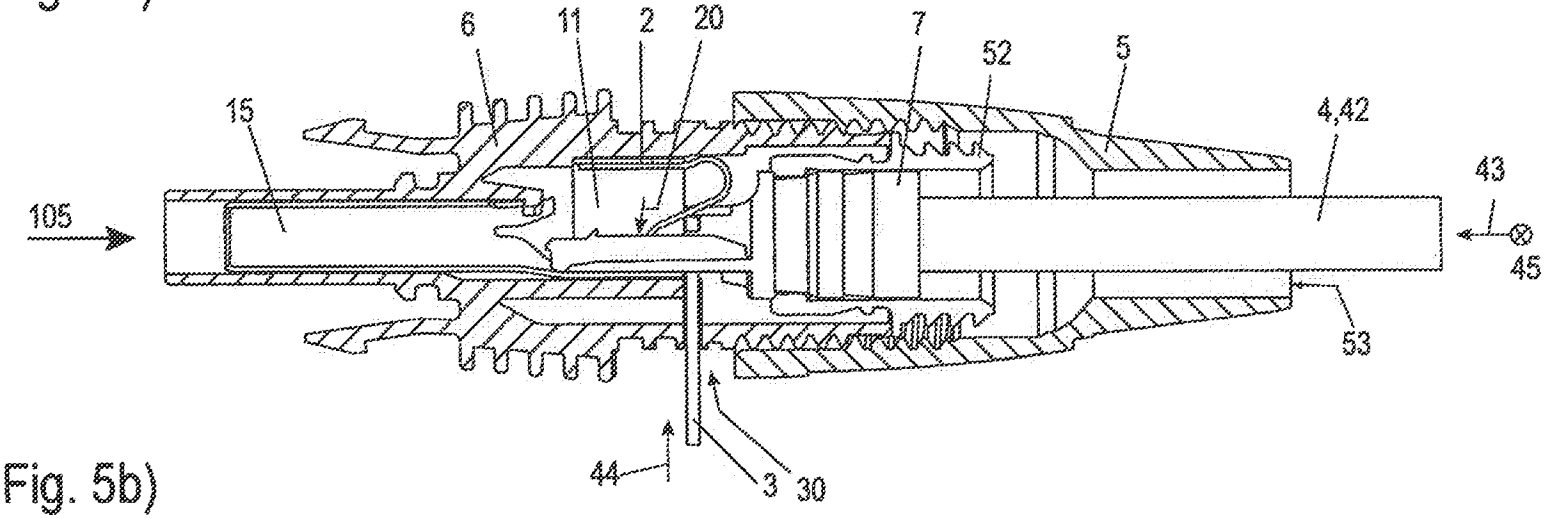
FIGS. 5*a* and 5*b* are sectional views of a fifth embodiment of an electrical plug connector with a release element in the engaged and released positions, respectively.
Figure 5B:
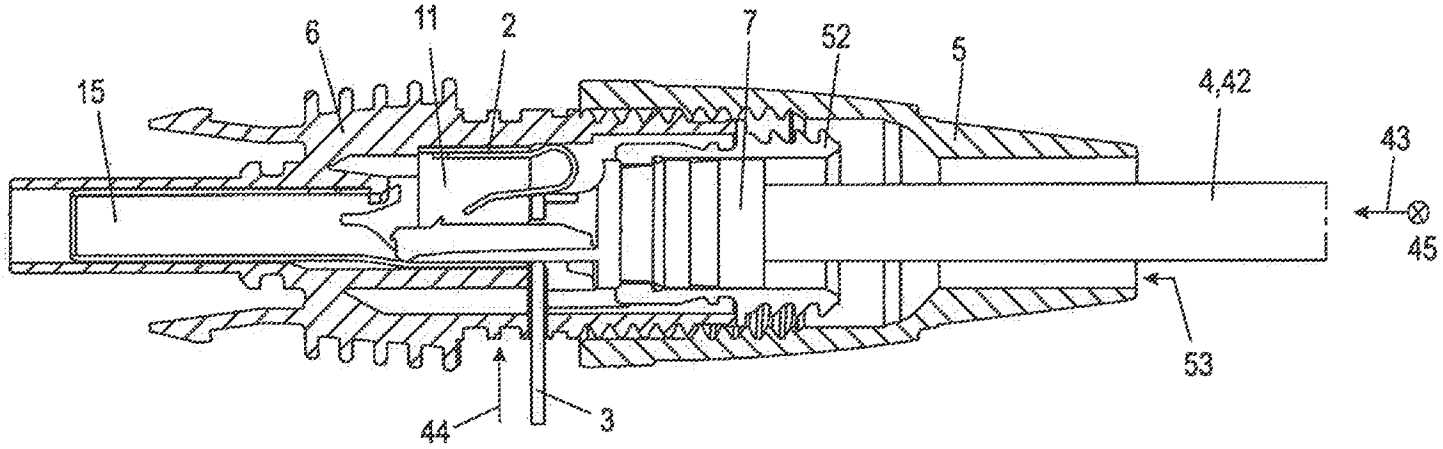

The plug connector 10 of the embodiment of FIGS. 5*a* and 5*b* includes a release element 3 which extends in a release direction 44 transversely to the conductor insertion direction 43 and transversely to the extension direction 45. After screwing on of the plug-connector 10, in which the sleeve-like housing end 5 is shifted against the conductor insertion direction 43 with respect to the connection housing 6, the release element can be inserted into the connection housing through an insertion opening 30 provided in the connection housing 6. After the insertion, the release element 3 extends at least partially outside of the connection housing 6. By the release element, the first spring arm 22 of the clamping spring 2 can be lifted against the clamping direction 20 if a conductor 4 is clamped in the plug connector 10 in order to be able to remove the conductor against the conductor insertion direction 43.

The invention claimed is:

1. An electrical plug connector, comprising (a) a housing including a plug end for connecting the electrical plug connector with a mating plug connector and an open end opposite said plug end;

(b) an electrical contact arranged in said housing for connection with an electrical conductor inserted into said housing open end, said contact including a spring cage having a clamping spring and a busbar contact region opposite said clamping spring, said clamping spring being operable between a clamping position which clamps the electrical conductor against said busbar contact region of said contact and a release position wherein said clamping spring is disengaged from the electrical conductor;

(c) a sleeve arranged within said housing open end, said sleeve receiving said electrical conductor and being displaceable relative to said housing upon insertion of the electrical conductor into said housing open end; and (d) a release element formed from a metal plate arranged on said sleeve within said housing open end and operable to position said clamping spring in the release position to release the electrical conductor from said contact upon further insertion of the electrical conductor into said housing opening, whereby the electrical conductor can be removed from the plug connector.

2. The electrical plug connector according to claim 1, wherein said release element is configured as a pivot element for displacing said clamping spring to the release position.

3. The electrical plug connector according to claim 1, wherein said sleeve is displaced in a direction parallel to a direction in which the electrical conductor is inserted.

4. The electrical plug connector according to claim 1, wherein said sleeve includes a conductor receptacle arranged between said busbar contact region and said clamping spring of said contact for receiving the electrical conductor.

5. The electrical plug connector according to claim 4, wherein said sleeve and the electrical conductor can be shifted together in the conductor insertion direction.

6. The electrical plug connector according to claim 1, wherein said sleeve is displaceable from a delivery state in which the electrical conductor can be inserted into said spring cage within said housing into a connection state in which said clamping spring is in contact with the electrical conductor and clamps said electrical conductor within said spring cage, said release element being operable to return the plug connector to the delivery state.

7. The electrical plug connector according to claim 1, wherein said plate extends at least partially in the conductor insertion direction and can be shifted either (1) by shifting said sleeve in the conductor insertion direction and/or the clamping spring against the conductor insertion direction; or (2) by a tool in and/or against the conductor insertion direction, wherein said clamping spring is released from the conductor when said plate is shifted in the conductor insertion direction.

8. The electrical plug connector according to claim 1, wherein said sleeve protrudes axially from said housing open end.

9. The electrical plug connector according to claim 1, wherein said plate extends at least partially in a release direction transverse to the conductor insertion direction and is shifted in or against the release direction and wherein said clamping spring is released from the conductor when said plate is shifted in the release direction.

10. The electrical plug connector according to claim 1, wherein said clamping spring includes a first spring arm having a free end which clamps the electrical conductor in the clamping cage.

11. The electrical plug connector according to claim 10, wherein said clamping spring includes a second spring arm.

* * * * *